US010982397B2

(12) United States Patent
Hirman et al.

(10) Patent No.: US 10,982,397 B2
(45) Date of Patent: Apr. 20, 2021

(54) MILLING ROTOR

(71) Applicant: Caterpillar Paving Products Inc., Brooklyn Park, MN (US)

(72) Inventors: Colton John Hirman, Maple Grove, MN (US); Jeffrey Wayne Hoyle, Rogers, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 16/438,571

(22) Filed: Jun. 12, 2019

(65) Prior Publication Data

US 2020/0392677 A1 Dec. 17, 2020

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127; B28D 1/186; B28D 1/188; E21C 25/10; E21C 27/24
See application file for complete search history.

(56) References Cited

U.S. PATENT DOCUMENTS 4,697,850 A 10/1987 Tuneblom
6,224,163 B1 * 5/2001 Nies ..... E02F 3/20 299/39.2
7,066,555 B2 6/2006 Hansen et al.
2004/0145232 A1 * 7/2004 Sansone ..... B28D 1/188 299/39.8
2006/0255649 A1 * 11/2006 Dawood ..... E21C 35/18 299/87.1
2010/0244544 A1 * 9/2010 Buhr ..... B28D 1/188 299/64
2013/0033091 A1 * 2/2013 Rotsch ..... B28D 1/186 299/39.4
2014/0035346 A1 * 2/2014 Fundakowski ..... E21C 35/19 299/87.1
2014/0239700 A1 * 8/2014 Wachsmann ..... E01C 23/088 299/104
2015/0032433 A1 * 1/2015 Li ..... E21C 25/10 703/7
2017/0335686 A1 * 11/2017 Seibert ..... E21C 35/19

FOREIGN PATENT DOCUMENTS

CN 204039888 12/2014
EP 0202478 A1 * 11/1986 ..... E21C 25/10
GB 1441609 A * 7/1976 ..... E21C 27/22

* cited by examiner

*Primary Examiner* — Janine M Kreck
*Assistant Examiner* — Michael A Goodwin
(74) *Attorney, Agent, or Firm* — Leydig, Voit & Mayer, Ltd.

(57) ABSTRACT

A milling rotor includes a drum having a cylindrical wall disposed about a central axis of the drum. The milling rotor also includes a series of milling bit assemblies arranged in a spiral pattern on an outer surface of the cylindrical wall. The series of milling bit assemblies is configured to commence from a lateral plane that is transverse to the central axis of the drum and located partway along a length of the cylindrical wall. The series of milling bit assemblies is also configured to terminate proximate an end of the cylindrical wall. Each milling bit assembly is positioned such that an angle subtended by the series of milling bit assemblies with the lateral plane increases with increasing distance from the end of the cylindrical wall.

18 Claims, 5 Drawing Sheets

MILLING ROTOR

TECHNICAL FIELD

The present disclosure relates to a cold planer. More particularly, the present disclosure relates to a milling rotor for a cold planer.

BACKGROUND

Machines such as cold planers typically employ a milling rotor for operatively milling a desired depth of material from a work site. U.S. Pat. No. 7,066,555 (hereinafter referred to as "the '555 patent") discloses a milling mandrel that has a cylindrical barrel and a plurality of cutting bits that are removably attached to the barrel. In accordance with the '555 patent, the cutting bits are arranged in a pre-determined pattern on the cylindrical barrel via a bit location system.

Although the pre-determined pattern of arranging the cutting bits on the barrel of the milling mandrel is disclosed, the pre-determined pattern of the '555 patent, and that of other conventional milling rotors, is less than optimal in that at least some of the milled material may not be actively rendered in a flowable state to be transported from the work site to another location, for example, a dump truck. That is, once milled, a sub-optimized flow of the milled material may occur owing to inherent inadequacies of system design associated with conventionally designed milling rotors. This may cause at least some of the milled material to spill onto the work site creating undesired debris on the work site.

Hence, there is a need for a milling rotor that overcomes the aforementioned drawback by improving material flowability for transport from the work site to another location thereby improving an efficiency in operation of the milling rotor besides improving cleanliness of the work site.

SUMMARY OF THE DISCLOSURE

In an aspect of the present disclosure, a milling rotor includes a drum having a cylindrical wall disposed about a central axis of the drum. The milling rotor also includes a series of milling bit assemblies arranged in a spiral pattern on an outer surface of the cylindrical wall. The series of milling bit assemblies is configured to commence from a lateral plane that is transverse to the central axis of the drum and located partway along a length of the cylindrical wall. The series of milling bit assemblies is also configured to terminate proximate an end of the cylindrical wall. Each milling bit assembly is positioned such that an angle subtended by the series of milling bit assemblies with the lateral plane increases with increasing distance from the end of the cylindrical wall.

In another aspect of the present disclosure, a cold planer includes a frame and a milling rotor coupled to the frame. The milling rotor includes a drum having a cylindrical wall disposed about a central axis of the drum. The milling rotor also includes a series of milling bit assemblies arranged in a spiral pattern on an outer surface of the cylindrical wall. The series of milling bit assemblies is configured to commence from a lateral plane that is transverse to the central axis of the drum and located partway along a length of the cylindrical wall. The series of milling bit assemblies is also configured to terminate proximate an end of the cylindrical wall. Each milling bit assembly is positioned such that an angle subtended by the series of milling bit assemblies with the lateral plane increases with increasing distance from the end of the cylindrical wall.

In yet another aspect of the present disclosure, a method for increasing flowability of milled material from a milling rotor to a conveyor of a cold planer includes providing a drum having a cylindrical wall disposed about a central axis of the drum. The method also includes providing a series of milling bit assemblies to the drum, arranging the series of milling bit assemblies in a spiral pattern on an outer surface of the cylindrical wall, and configuring the series of milling bit assemblies to commence from a lateral plane that is transverse to the central axis of the drum and located partway along a length of the cylindrical wall. Further, the method also includes configuring the series of milling bit assemblies to terminate proximate an end of the cylindrical wall. Furthermore, the method also includes positioning each milling bit assembly such that an angle subtended by the series of milling bit assemblies with the lateral plane increases with increasing distance from the end of the cylindrical wall.

Other features and aspects of this disclosure will be apparent from the following description and the accompanying drawings.

DETAILED DESCRIPTION

Wherever possible, the same reference numbers will be used throughout the drawings to refer to the same or like parts.

Figure 1:
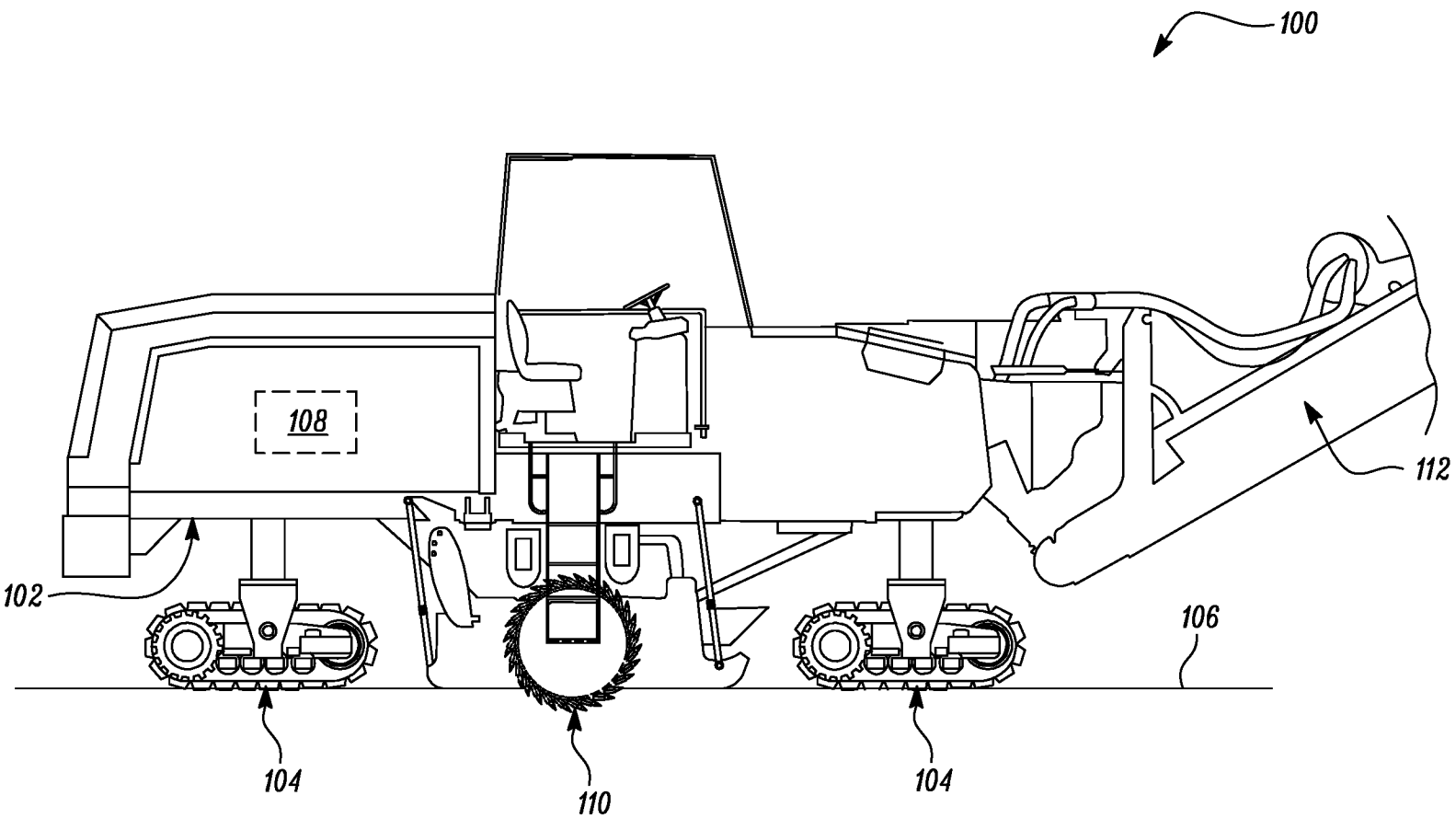
FIG. 1 is a side view of a cold planer showing a frame and a milling rotor coupled to the frame according to an embodiment of the present disclosure.

Referring to FIG. 1, a cold planer 100 is illustrated in accordance with an embodiment of the present disclosure. As shown, the cold planer 100 includes a frame 102. The frame 102 may be configured to rotatably support a plurality of ground engaging members 104 thereon. The ground engaging members 104 may include tracks as exemplarily shown in the view of FIG. 1. In other embodiments, the ground engaging members 104 may include, for example, wheels in lieu of the tracks disclosed herein.

The ground engaging members 104 may be operatively rotated relative to the frame 102 for propelling the cold planer 100 on a work surface 106. The ground engaging members 104 may be driven using power output by a prime mover 108 located on the cold planer 100. The prime mover 108 may include, for example, an engine, an electric motor, or any other type of prime mover known to persons skilled in the art.

The cold planer 100 includes a milling rotor 110 that is coupled to the frame 102. The milling rotor 110 is operatively rotatable in relation to the frame 102 and the work surface 106 for milling a desired depth of material from the work surface 106. The milling rotor 110 may be driven using power output by the prime mover 108, or another power source (not shown) located on the cold planer 100. Further, the cold planer 100 may also include a conveyor 112 disposed in communication with the milling rotor 110 and located at a front portion of the frame 102. The conveyor 112 may be configured to operatively transport the milled material from the milling rotor 110 to another location, for example, a dump truck (not shown).

Explanation to the milling rotor 110 and its components will be made hereinafter. Although the appended explanation is made in reference to the milling rotor 110 that is used in conjunction with the cold planer 100, it is to be noted that such implementation of the milling rotor 110 for use with the cold planer 100 is merely illustrative in nature and hence, non-limiting of the present disclosure. It will be acknowledged by persons skilled in the art that embodiments disclosed herein may be similarly applied to produce the milling rotor 110 for use on other types of machines, stationary or mobile, that may be associated with a milling application.

Figure 2:
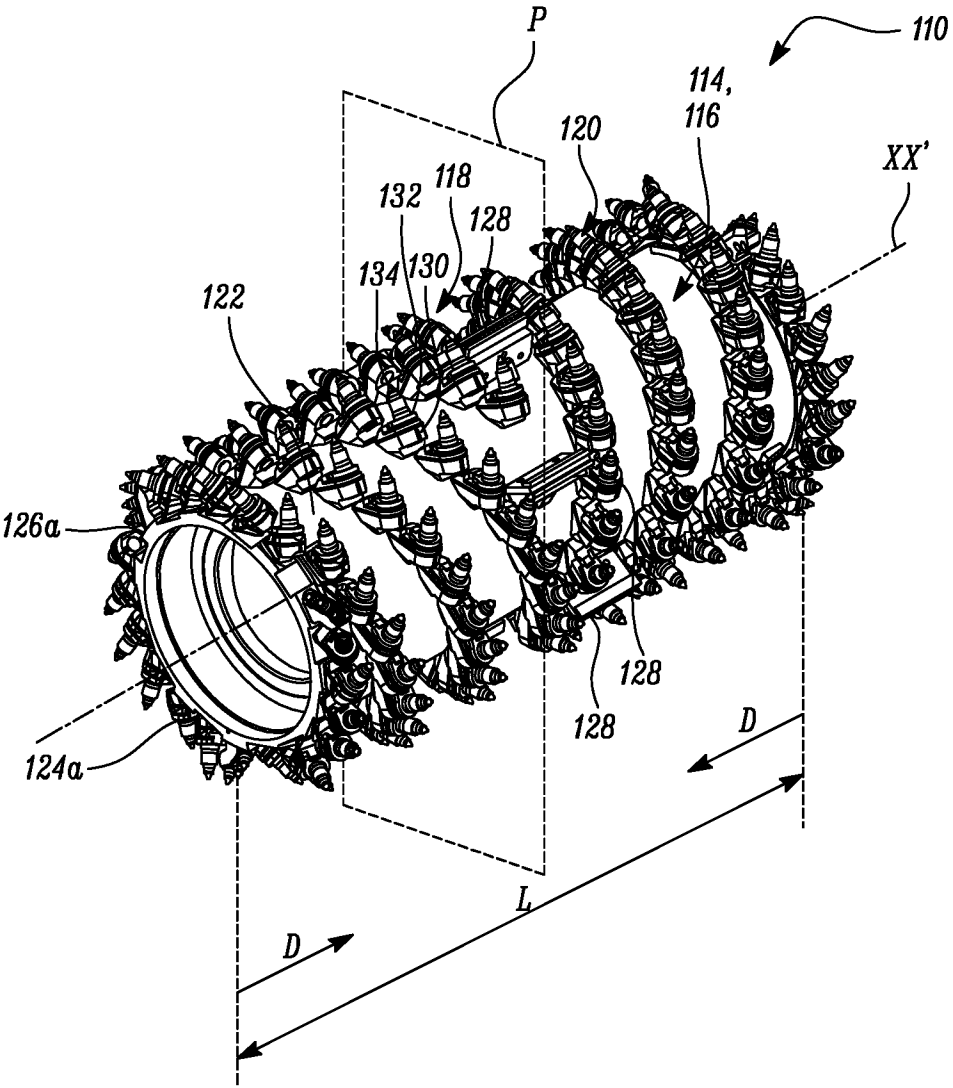
FIG. 2 is a top perspective view of the milling rotor having a drum and showing a close-up of a milling bit assembly from a series of milling bit assemblies that are arranged spirally on the drum, according to an embodiment of the present disclosure.
Figure 3:
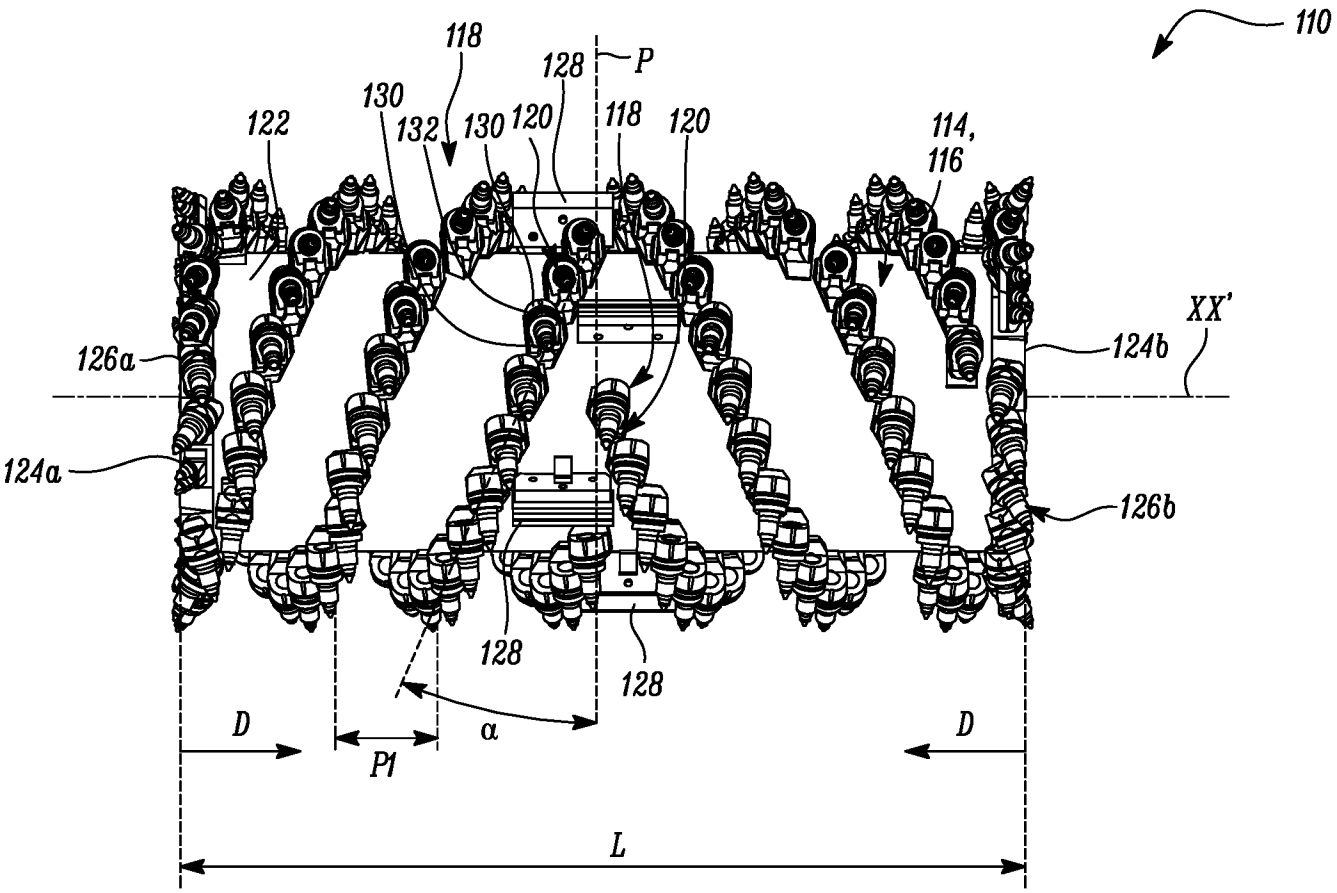
FIG. 3 is a front elevation view of the milling rotor.
Figure 4:
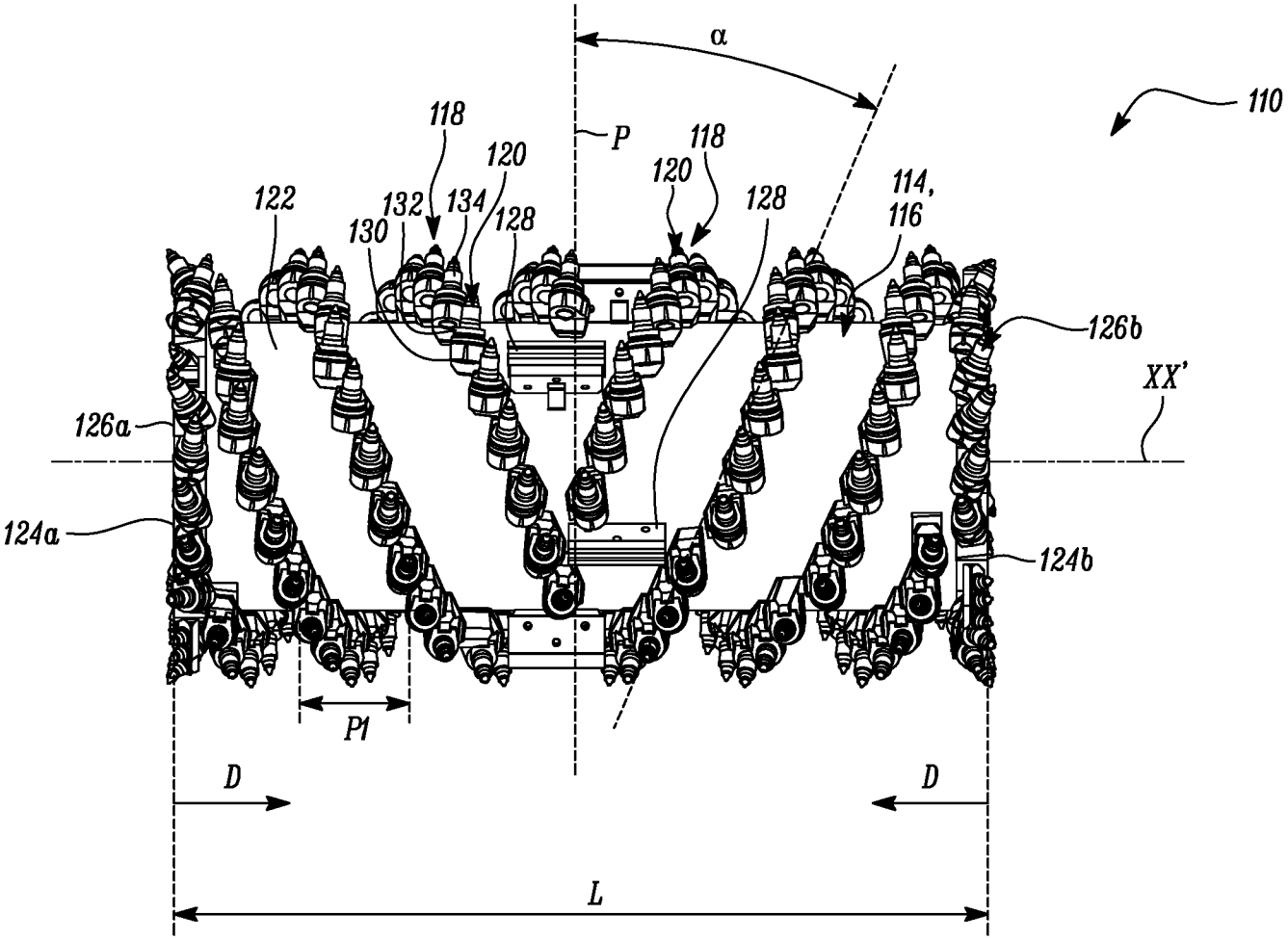
FIG. 4 is a rear elevation view of the milling rotor.

Referring to FIGS. 2-4, the milling rotor 110 includes a drum 114 having a cylindrical wall 116 disposed about a central axis XX' of the drum 114. The milling rotor 110 also includes a series 118 of milling bit assemblies 120 that are arranged in a spiral pattern on an outer surface 122 of the cylindrical wall 116. For sake of brevity in this disclosure, the series 118 of milling bit assemblies 120 will hereinafter be referred to as "the series 118 of bit assemblies 120.

In an embodiment, the milling rotor 110 may include multiple series 118 of bit assemblies 120. Exemplarily, the milling rotor 110 shown in FIGS. 3 and 4 has six distinct series 118 of bit assemblies 120, three distinct series 118 of bit assemblies 120 being visible in each of the views of FIGS. 3 and 4 respectively. Although six series 118 of bit assemblies 120 are disclosed herein, in other embodiments, fewer or more series 118 of bit assemblies 120 may be implemented for use on the milling rotor 110 depending on specific requirements of an application. Further, explanation hereinafter will be made in reference to a singular series 118 of bit assemblies 120. However, such explanation should be understood as being similarly applicable to each series 118 of bit assemblies 120 located on the drum 114 of the milling rotor 110.

The series 118 of milling bit assemblies 120 is configured to commence from a lateral plane 'P' that is transverse to the central axis XX' of the drum 114 and located partway along a length 'L' of the cylindrical wall 116. In an embodiment as shown best in the views of FIGS. 2-4, the lateral plane 'P' may be located halfway along the length 'L' of the cylindrical wall 116. Further, the series 118 of milling bit assemblies 120 is also configured to terminate proximate an end 124*a*/124*b* of the cylindrical wall 116. Furthermore, each milling bit assembly 120 is positioned such that an angle 'α' subtended by the series 118 of milling bit assemblies 120 with the lateral plane 'P' increases with increasing distance 'D' from the end 124*a*/124*b* of the cylindrical wall 116. Stated differently, a pitch 'P1' associated with each series 118 of bit assemblies 120 increases with increasing distance 'D' from the end 124*a*/124*b* of the cylindrical wall 116.

In the milling rotor 110 of the present disclosure, the angle 'α' subtended by the series 118 of milling bit assemblies 120 with the lateral plane 'P' may be a linear or a non-linear function of the distance 'D' from the end 124*a*/124*b* of the cylindrical wall 116. In regards to the non-linear function, the angle 'α' subtended by the series 118 of milling bit assemblies 120 with the lateral plane 'P' may progressively increase with increasing distance 'D' from the end 124*a*/124*b* of the cylindrical wall 116 in an exponential, logarithmic, or any other suitable non-linear manner as known to persons skilled in the art. Accordingly, the progressive increase in pitch 'P1' associated with each series 118 of bit assemblies 120 may be configured to occur in an exponential, logarithmic, or any other suitable non-linear manner as known to persons skilled in the art in relation to the increase in the distance 'D' from the end 124*a*/124*b* of the cylindrical wall 116.

In this disclosure, wherever the context so applies, explanation will be made in reference to successive series 118 of bit assemblies 120. Such explanation should be construed as being made in reference to a pair of series 118 of bit assemblies 120 that are adjacently located to each other along a lateral plane 'P' of the milling rotor 110.

In an embodiment as shown best in the view of FIG. 2, successive series 118 of bit assemblies 120 are radially offset from one another along the lateral plane 'P'. Also, in an embodiment as shown best in the views of FIGS. 3 and 4, successive series 118 of bit assemblies 120 are configured to terminate at opposing ends 124*a*,124*b* of the cylindrical wall 116. Further, in an embodiment as best shown in the views of FIGS. 3 and 4, successive series 118 of bit assemblies 120 are configured to terminate into a pair of annularly arranged series 126*a*, 126*b* of bit assemblies 120 arranged at opposing ends 124*a*,124*b* of the cylindrical wall 116.

In an embodiment as shown in the view of FIGS. 2-4, the milling rotor 110 also includes multiple paddles 128 that are configured to protrude radially from the outer surface 122 of the cylindrical wall 116. These paddles 128 may be disposed along, or at least proximal to, the lateral plane 'P' of the milling rotor 110 and may be arranged between successive series 118 of bit assemblies 120.

Referring to the close-up depicted in the view of FIG. 2, in an embodiment, each bit assembly 120 may include a mounting block 130 protruding from the outer surface 122 of the cylindrical wall 116 of the drum 114. Further, each bit assembly 120 may also include a tool holder 132 coupled to the mounting block 130 and a bit 134 that may be releasably engaged with the tool holder 132. As commonly known to persons skilled in the art, the bit 134 may be embodied to have a carbide tip therein, or any other suitable material that is configured to perform functions consistent with that typical of a milling application.

INDUSTRIAL APPLICABILITY

Figure 5:
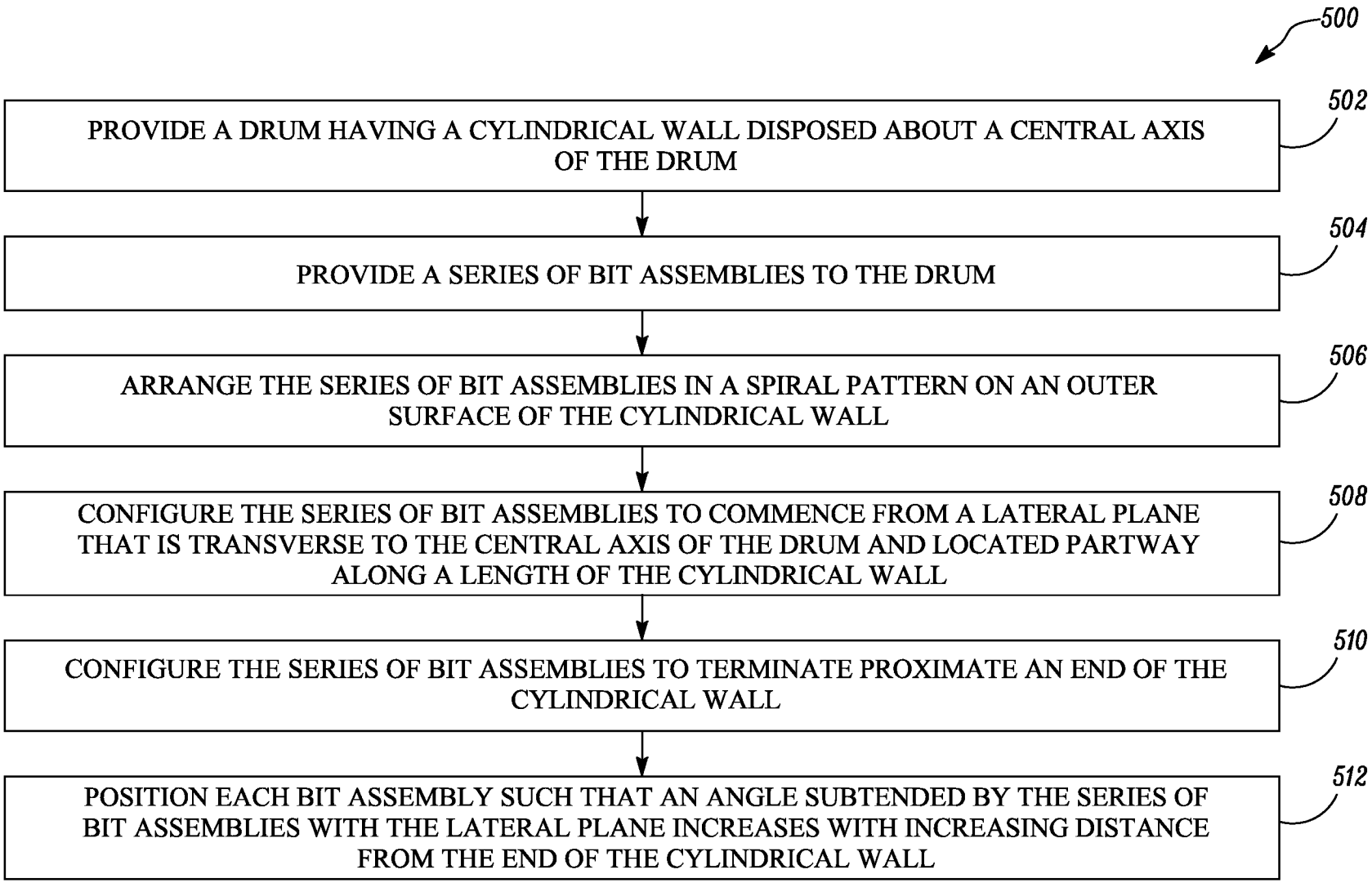
FIG. 5 is a method of increasing flowability of milled material from the milling rotor to a conveyor of a cold planer, according to an embodiment of the present disclosure.

FIG. 5 illustrates a flowchart of a method for increasing flowability of milled material from the milling rotor 110 to the conveyor 112 of the cold planer 100. As shown at step 502, the method 500 includes providing a drum 114 having a cylindrical wall 116 disposed about a central axis XX' of the drum 114. Further, at step 504, the method 500 also includes providing a series 118 of bit assemblies 120 to the drum 114. Furthermore, as shown at step 506, the method 500 also includes arranging the series 118 of bit assemblies 120 in a spiral pattern on an outer surface 122 of the cylindrical wall 116.

Moreover, at step 508, the method 500 also includes configuring the series 118 of bit assemblies 120 to commence from a lateral plane 'P' that is transverse to the central axis XX' of the drum 114 and located partway along a length 'L' of the cylindrical wall 116. Further, at step 510, the method 500 also includes configuring the series 118 of bit assemblies 120 to terminate proximate an end 124*a*/124*b* of the cylindrical wall 116. Furthermore, at step 512, the method 500 also includes positioning each bit assembly 120 such that an angle 'α' subtended by the series 118 of bit assemblies 120 with the lateral plane 'P' increases with increasing distance 'D' from the end 124*a*/124*b* of the cylindrical wall 116. In an embodiment, the method 500 includes positioning each bit assembly 120 such that the angle 'α' subtended by the series 118 of bit assemblies 120 with the lateral plane 'P' is a non-linear function of the distance 'D' from the end 124*a*/124*b* of the cylindrical wall 116.

The present disclosure has applicability for use and implementation in producing a milling rotor 110 that operationally improves a flowability of milled material for transport from a work surface 106 to another location, for example, a dump truck. The milling rotor 110 disclosed herein has one or more series 118 of milling bit assemblies 120 that are arranged in a spiral pattern on an outer surface 122 of the drum 114. Each milling bit assembly 120 is positioned such that the angle 'α' subtended by the series 118 of milling bit assemblies 120 with the lateral plane 'P' increases with increasing distance 'D' from the end 124*a*/124*b* of the cylindrical wall 116. It is hereby envisioned that due to the increase in the angle 'α' subtended by the series 118 of milling bit assemblies 120 with the lateral plane P with increasing distance 'D' from the end 124*a*/124*b* of the cylindrical wall 116, the series 118 of but assemblies on the milling rotor 110 of the present disclosure is configured to create an improved 'auger-like' effect on the milled material in that the material milled by milling rotor 110 distally away from the lateral plane 'P' i.e., proximate to, or at, the pair of annularly arranged series 126*a*, 126*b* of bit assemblies 120 of the milling rotor 110 is drawn more aggressively by the increasing angle 'α' subtended by the series 118 of milling bit assemblies 120 with the lateral plane 'P'.

Due to the improved 'auger-like' effect, a flowability of the milled material from extremities of the milling rotor 110 towards the paddles 128 located at, or proximate to, the lateral plane 'P' of the milling rotor 110 is consequently improved. The paddles 128 can, in simultaneous operation with the series 118 of bit assemblies 120, transport a maximum amount of the milled material onto the conveyor 112 of the cold planer 100. Subsequently, the conveyor 112 may transport the milled material to another location, for example, a dump truck, thereby leaving the work surface 106 free of any undesired debris by preventing any residual milled material left behind on the work surface 106. Therefore, with implementation and use of embodiments disclosed herein, additional costs, time, and effort previously incurred in cleaning up any debris i.e., any residual milled material left behind on the work surface 106 is mitigated to the maximum extent possible.

While aspects of the present disclosure have been particularly shown and described with reference to the embodiments above, it will be understood by those skilled in the art that various additional embodiments may be contemplated by the modification of the disclosed cold planer 100 or the milling rotor 110 without departing from the spirit and scope of the disclosure. Such embodiments should be understood to fall within the scope of the present disclosure as determined based upon the claims and any equivalents thereof.

What is claimed is:

1. A milling rotor, the milling rotor comprising:

a drum having:

a cylindrical wall disposed about a central axis of the drum; and a first series of milling bit assemblies arranged in a spiral pattern on an outer surface of the cylindrical wall, the first series of milling bit assemblies configured to commence from a lateral plane, transverse to the central axis of the drum and located approximately halfway along an axial length of the cylindrical wall, and terminate proximate a first axial end of the cylindrical wall;

a second series of milling bit assemblies arranged in a spiral pattern on the outer surface of the cylindrical wall, the second series of milling bit assemblies configured to commence from the lateral plane and terminate proximate a second axial end of the cylindrical wall opposite the first axial end; wherein:

each milling bit assembly is positioned such that angles subtended by the first series of milling bit assemblies and the second series of milling bit assemblies with the lateral plane increases with increasing distance from the respective first axial end second axial end of the cylindrical wall.

2. The milling rotor of claim 1, wherein a pitch associated with the first and second series of milling bit assemblies increases with increasing distance from the respective first and second axial end of the cylindrical wall.

3. The milling rotor of claim 1, wherein the increase in the angle subtended by the first and second series of milling bit assemblies with the lateral plane is one of: a linear and a non-linear function of the distance from the respective first axial and second axial end of the cylindrical wall.

4. The milling rotor of claim 1, wherein the first and second series of milling bit assemblies includes multiple series of milling bit assemblies.

5. The milling rotor of claim 4, wherein successive series of milling bit assemblies are radially offset from one another along the lateral plane.

6. The milling rotor of claim 4, wherein successive series of milling bit assemblies are configured to terminate at opposing first and second axial ends of the cylindrical wall.

7. The milling rotor of claim 4, wherein successive series of milling bit assemblies are configured to terminate into a pair of annularly arranged series of milling bit assemblies arranged at opposing first and second axial ends of the cylindrical wall.

8. The milling rotor of claim 4 further comprising a plurality of paddles protruding radially from the outer surface of the cylindrical wall, the plurality of paddles disposed along, or at least proximal to, the lateral plane and arranged between successive series of milling bit assemblies.

9. A cold planer comprising:

a frame;

a milling rotor coupled to the frame, the milling rotor comprising:

a drum having:

a cylindrical wall disposed about a central axis of the drum; and a first series of milling bit assemblies arranged in a spiral pattern on an outer surface of the cylindrical wall, the first series of milling bit assemblies configured to commence from a lateral plane, transverse to the central axis of the drum and located approximately halfway partway along an axial length of the cylindrical wall, and terminate proximate a first axial end of the cylindrical wall;

a second series of milling bit assemblies arranged in a spiral pattern on the outer surface of the cylindrical wall, the second series of milling bit assemblies configured to commence from the lateral plane and terminate proximate a second axial end of the cylindrical wall opposite the first axial end;

wherein each milling bit assembly is positioned such that angles subtended by the first and second series of milling bit assemblies with the lateral plane increase[s] with increasing distance from the respective first and second axial ends of the cylindrical wall.

10. The cold planer of claim 9, wherein a pitch associated with the first and second series of milling bit assemblies increases with increasing distance from the respective first and second axial end of the cylindrical wall.

11. The cold planer of claim 9, wherein the increase in the angle subtended by the first and second series of milling bit assemblies with the lateral plane is one of: a linear and a non-linear function of the distance from the respective first and second end of the cylindrical wall.

12. The cold planer of claim 9, wherein the first and second series of milling bit assemblies includes multiple series of milling bit assemblies.

13. The cold planer of claim 12, wherein successive series of milling bit assemblies are radially offset from one another along the lateral plane.

14. The cold planer of claim 12, wherein successive series of milling bit assemblies are configured to terminate at opposing first and second axial ends of the cylindrical wall.

15. The cold planer of claim 9, wherein successive series of milling bit assemblies are configured to terminate into a pair of annularly arranged series of milling bit assemblies arranged at opposing ends of the cylindrical wall.

16. The cold planer of claim 9, wherein the milling rotor further comprising a plurality of paddles protruding radially from the outer surface of the cylindrical wall, the plurality of paddles disposed along, or at least proximal to, the lateral plane and arranged between successive series of milling bit assemblies.

17. A method for increasing flowability of milled material from a milling rotor to a conveyor of a cold planer, the method comprising:

providing a drum having a cylindrical wall disposed about a central axis of the drum;

providing a first series of milling bit assemblies to the drum;

providing a second series of milling bit assemblies to the drum;

arranging the first and second series of milling bit assemblies each in a spiral pattern on an outer surface of the cylindrical wall;

configuring the first series of milling bit assemblies to commence from a lateral plane, transverse to the central axis of the drum and located approximately halfway along an axial length of the cylindrical wall, and terminate proximate an axial first end of the cylindrical wall;

configuring the second series of milling bit assemblies to commence from a lateral plane traverse to the central axis of the drum and terminate proximate a second axial end of the cylindrical wall; and positioning each milling bit assembly such that angles subtended by the first and second series of milling bit assemblies with the lateral plane increases[ ] with increasing distance from the respective first and second axial ends of the cylindrical wall.

18. The method of claim 17 further comprising positioning each milling bit assembly such that the angle subtended by the series of milling bit assemblies with the lateral plane is a non-linear function of the distance from the end of the cylindrical wall.

* * * * *